US005161999A

United States Patent [19]

Broschard, III et al.

[11] Patent Number: 5,161,999

[45] Date of Patent: Nov. 10, 1992

[54] SURFACE MOUNT ELECTRICAL COHNNECTOR AND SHIELD THEREFOR

[75] Inventors: John L. Broschard, III, Harrisburg; Earl W. McCleerey, Mechanicsburg; John A. Root, Middletown, all of Pa.

[73] Assignee: AMP Incorporated, Harrisburg, Pa.

[21] Appl. No.: 853,649

[22] Filed: Mar. 18, 1992

[51] Int. Cl.[5] ..... H01R 13/658; H01R 13/73

[52] U.S. Cl. ..... 439/567; 439/607

[58] Field of Search ..... 439/108, 540, 607, 608, 439/609, 82, 83, 554, 567, 571

[56] References Cited

U.S. PATENT DOCUMENTS

| | | | |
|---|---|---|---|
| 4,601,527 | 7/1986 | Lemke | 439/608 |
| 4,684,197 | 10/1987 | Reichardt et al. | 439/404 |
| 4,789,357 | 12/1988 | Yamaguchi et al. | 439/607 |
| 4,806,109 | 2/1989 | Manabe et al. | 439/108 |
| 4,808,125 | 2/1989 | Waters et al. | 439/607 |
| 4,842,552 | 6/1989 | Frantz | 439/557 |
| 4,889,502 | 12/1989 | Althouse et al. | 439/607 |
| 4,902,242 | 2/1990 | Davis et al. | 439/404 |
| 5,030,140 | 7/1991 | Sugiyama | 439/607 |
| 5,037,330 | 8/1991 | Fulponi et al. | 439/607 |
| 5,037,331 | 8/1991 | Goodman et al. | 439/607 |
| 5,044,984 | 9/1991 | Mosser et al. | 439/540 |
| 5,080,609 | 1/1992 | Fabian et al. | 439/540 |
| 5,085,590 | 2/1992 | Galloway | 439/95 |

FOREIGN PATENT DOCUMENTS

| | | | |
|---|---|---|---|
| 2-57583 | 10/1990 | Japan | 439/607 |

*Primary Examiner*—Gary F. Paumen
*Attorney, Agent, or Firm*—David L. Smith

[57] ABSTRACT

An electricl connector (1) for mounting on a circuit board includes a housing (2) having a pair of spaced, rudimentary bottom walls (30) each having a bottom surface (31) for engaging against the circuit board. Each bottom wall (30) has formed therein, a through bore (39) opening into the bottom face (31) and also opening upwardly. A hollow board lock supported in each of the bores (39) has locking legs (37) projecting below the bottom face of the respective bottom wall (30) for insertion in a hole (H2) in a circuit board. The housing (2) has therein a header (8) carrying electrical terminals (64,66,68,70) having terminal legs (76) projecting rearwardly from the header (8) and terminating in soldering tails (78) depending below the housing for insertion in further holes (H1) in the circuit board when the bottom faces (31) of the bottom walls (30) are engaged with the circuit board. A metal shield (18) covering the terminal legs (76 ) has, projecting from opposite side walls (80) of the shield (18) grounding tabs (100) which extend through respective board locks (41) and between their locking legs (76). When the connector (1) is mounted on the circuit board the soldering tails (78) are soldered to signal conductors on the board and the legs (76) of the board locks (41) are soldered to grounding conductors on the board. The grounding tabs (100) are accordingly soldered to the grounding conductors at the same time as the locking legs (37).

21 Claims, 8 Drawing Sheets

SURFACE MOUNT ELECTRICAL COHNNECTOR AND SHIELD THEREFOR

This invention relates to an electrical connector for mounting to a circuit board and to a metal shield therefor. The invention particularly concerns right angle electrical connector and a metal shield therefor.

BACKGROUND OF THE INVENTION

U.S. Pat. Nos. 4,842,552 and U.S. Pat. No. 5,044,984, for example, disclose right angle-electrical connectors which are secured to circuit boards by means of board locks which extend through bores in the flanges of the connectors. Such a board lock comprises an annular strap which is seated in the respective bore and has means for securing it therein, and a plurality of locking legs extending from the strap below the flange and having outwardly bowed end portions for engaging beneath a circuit board when the legs have been inserted through a hole therein. U.S. Pat. No. 4,806,109 discloses a surface mount right angle electrical connector from which project an array of terminal legs terminating in solder tails for insertion through holes in a circuit board, and a metal shield covering the terminal legs and having grounding tabs projecting therefrom for insertion through further holes in the circuit board to be soldered to ground conductor means thereon, the solder tails of the terminals being soldered to signal conductors on the board. The shield has a rearwardly and downwardly inclined wall from which projects a lower wall portion, from a bottom edge of which the grounding tabs project.

U.S. Pat. No. 5,037,330 discloses a right angle electrical connector having a metal shield having side walls from which project struck out flanges which engage in external grooves in insulating housings of the connector which are received within the shield. With the bowed mounting feet project from bottom edges of the shield side walls for insertion through holes in a circuit board to retain the connector thereon.

SUMMARY OF THE INVENTION

The invention concerns the reduction of the number of plated through holes that must be provided in circuit boards, for receiving grounding tabs on connector shields, and the risk of such tabs being bent or damaged by stubbing against the board when the connector is being mounted thereon, as well as damage to the tabs when the connector is being handled.

An electrical connector for mounting on a circuit board comprises, according to the invention, a housing having a bottom wall with a bottom face for engaging against the circuit board, the bottom wall having formed therein a through bore opening into said bottom face. A hollow board lock supported in the through bore, has locking legs projecting below the bottom face for insertion in a first hole in the circuit board. A header in the housing carries electrical terminals with terminal legs thereof projecting from the header and terminating in soldering tails depending below the bottom face of the housing for insertion into second holes in the circuit board with the bottom face of the housing engaging it. A metal shield covering the terminal legs has depending therefrom a grounding tab projecting through the board lock and between the locking legs thereof.

When the connector has been mounted on the circuit board, with the locking legs of the board lock projecting through the first hole and the soldering tails projecting through the second holes, the board lock and the soldering tails are soldered to respective ground and signal conductors on the underside of the board. The grounding tab which projects between the locking legs of the board lock, is accordingly simultaneously soldered to the same grounding conductor. The drilling program for the board is thereby simplified and lining metal is saved. Further, the board lock serves to protect the grounding tab from stubbing against the board when the connector is being mounted thereto, or the grounding tab being otherwise damaged when the connector is being handled.

Preferably, the connector is provided with a plurality of board locks and a grounding tab on the shield projecting through each board lock The shield may, however, be provided with grounding tabs, if necessary, for insertion through other plated through holes in the circuit board.

The bores for the board locks may be formed in spaced, rudimentary bottom walls of the housing, the housing having a top wall and the shield having a top flap resiliently engaging beneath the top wall of the housing whereby the side walls of the shield, from which the grounding tabs project, are resilient urged against said bottom walls of the housing. The shield may be received between side walls projecting from a front wall of the housing in which the header is fixed, a side wall of the shield having latching tongues engaged in grooves in the housing side walls. In order to assemble the shield to the housing, the shield is moved down vertically between the side walls, so that the grounding tabs enter the board locks and the latching tongues engage the grooves, the flap being resiliently depressed and located beneath the top wall of the housing. In order to locate the grounding tabs for insertion through the board locks, the grounding tabs are offset inwardly from the side walls of the shield.

DESCRIPTION OF THE PREFERRED EMBODIMENT

Figure 1:
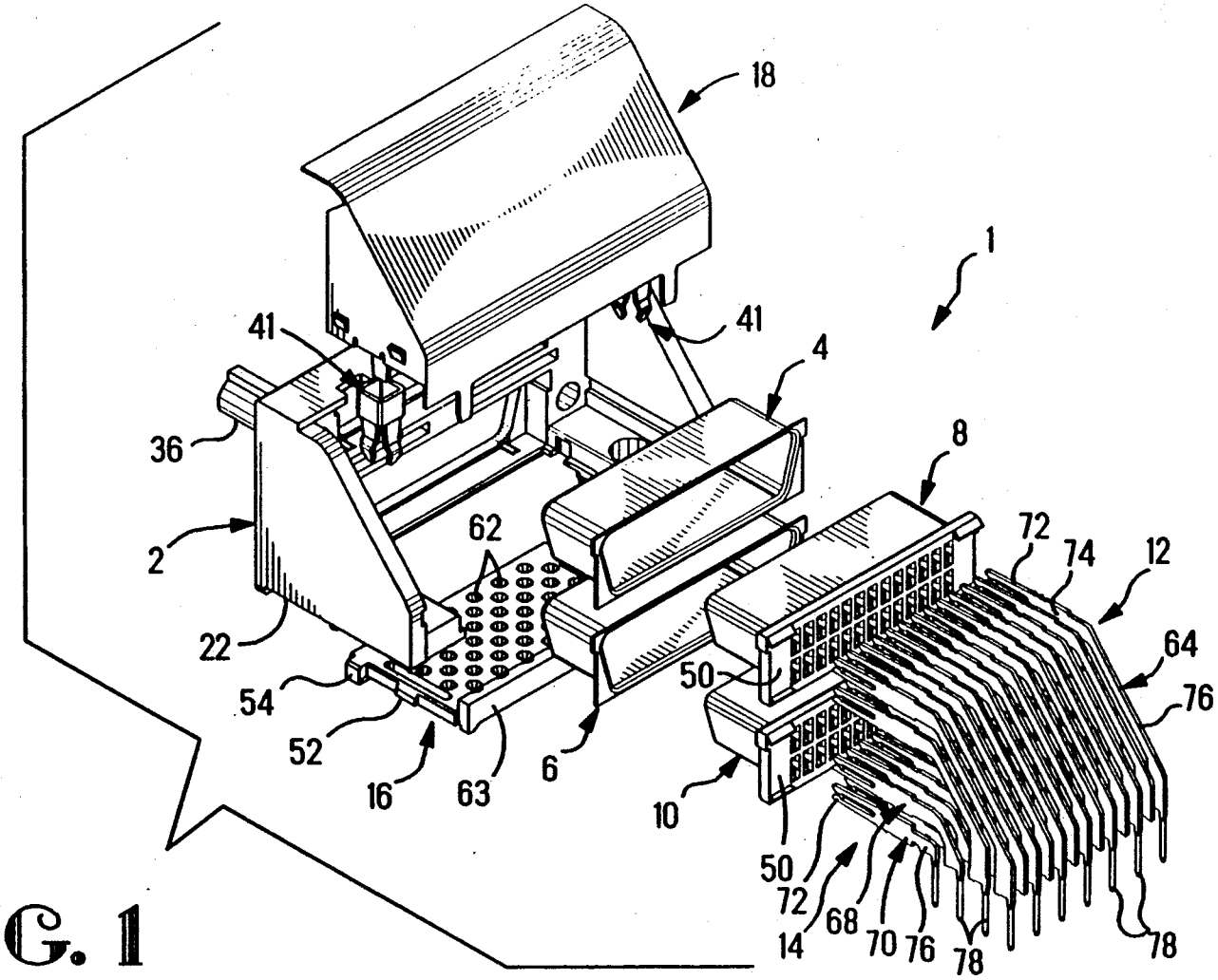
FIG. 1 is an exploded isometric view of a stacked, right angle electrical connector showing a preferred embodiment of a metal shield thereof.
Figure 2:
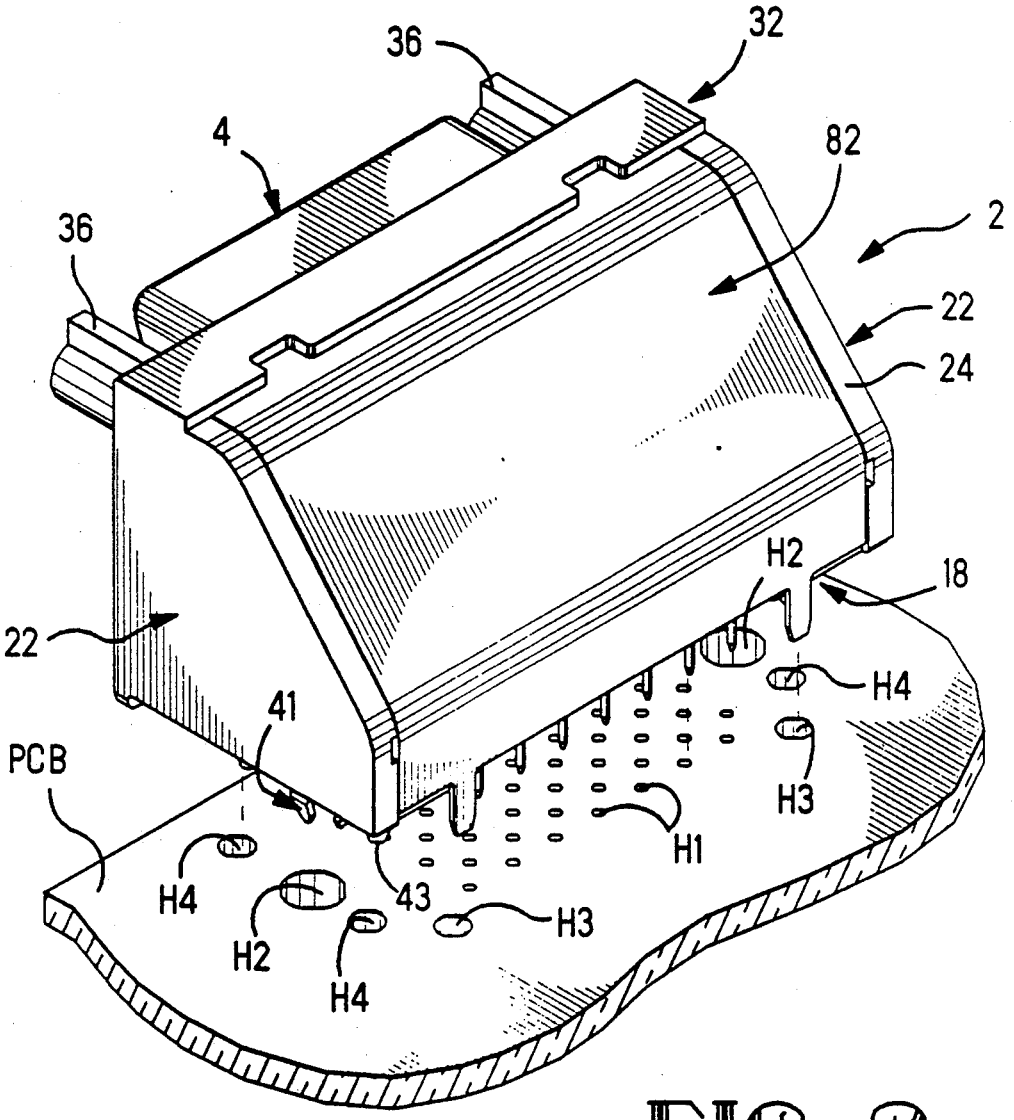
FIG. 2 is a rear isometric view of the connector in its assembled state, exploded from a circuit board.

A shielded, stacked, right angle, electrical connector 1, for mounting on a circuit board PCB, is shown in the exploded perspective view of FIG. 1. The connector, which may be used in the computer field as an input-/output port, comprises a die cast metal housing 2, receiving upper and lower drawn metal shells 4 and 6 respectively, the shells 4 and 6 receiving insulating upper and lower header inserts 8 and 10, respectively, the inserts 8 and 10, in turn receiving upper and lower groups 12 and 14, respectively of an array of electrical terminals. The connector 1 further comprises a terminal tail spacer plate 16 and a metal shield 18 covering the rear of the housing 2. The connector 1 will now be described with reference to FIGS. 1 to 11.

Figure 3:
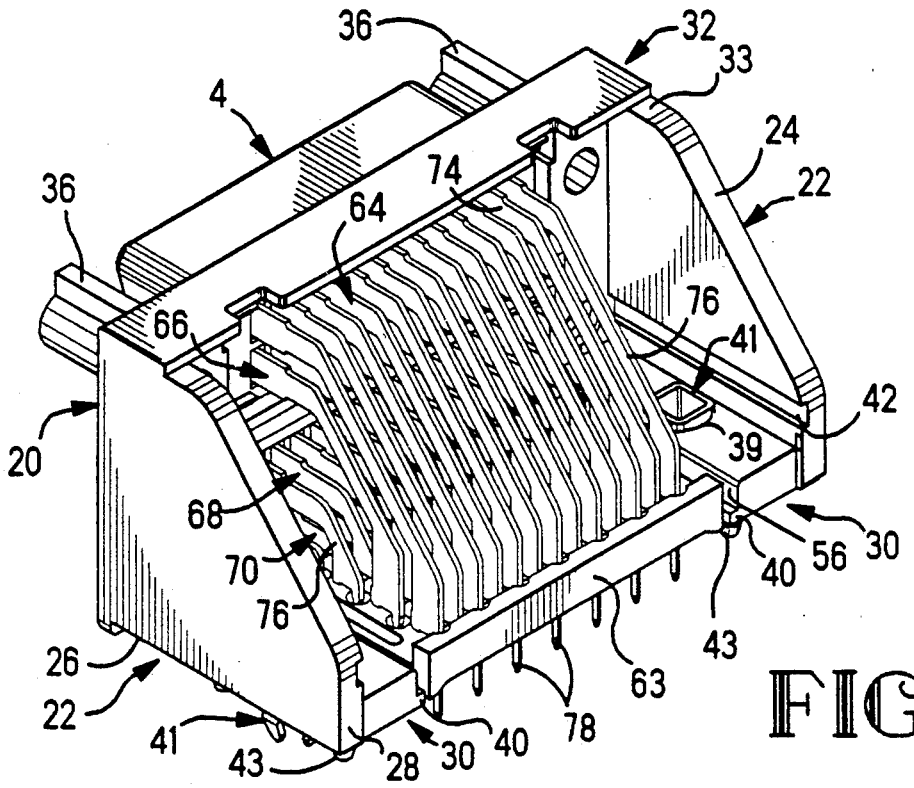
FIG. 3 is a rear isometric view of the connector of FIG. 2, with the shield removed.
Figure 4:
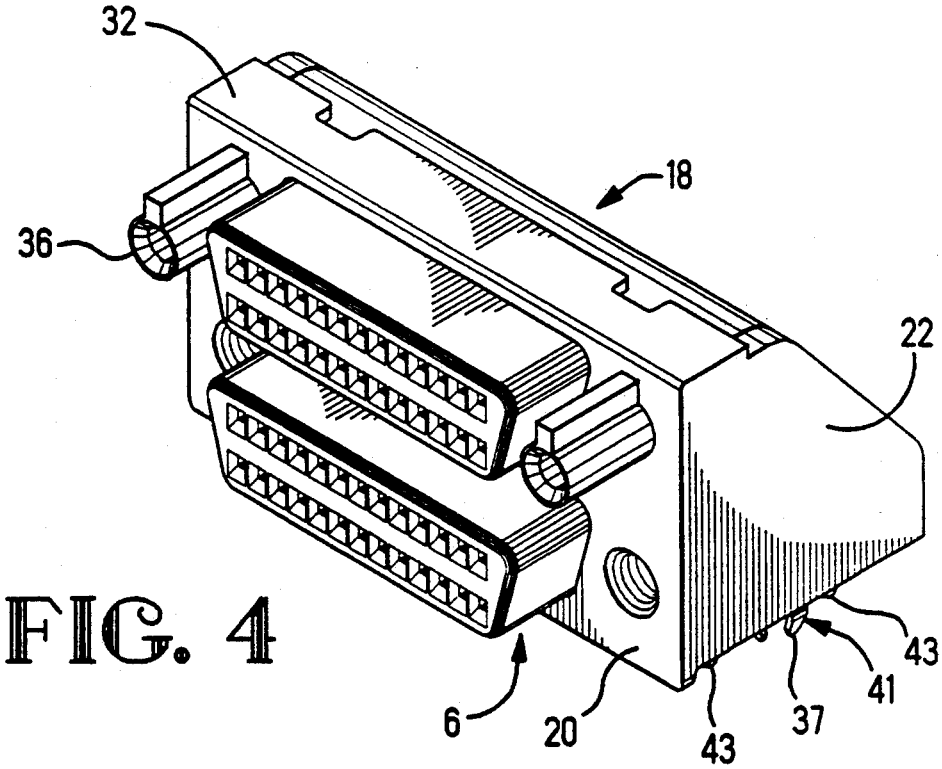
FIG. 4 is a front isometric view of the connector of FIG. 2.
Figure 5:
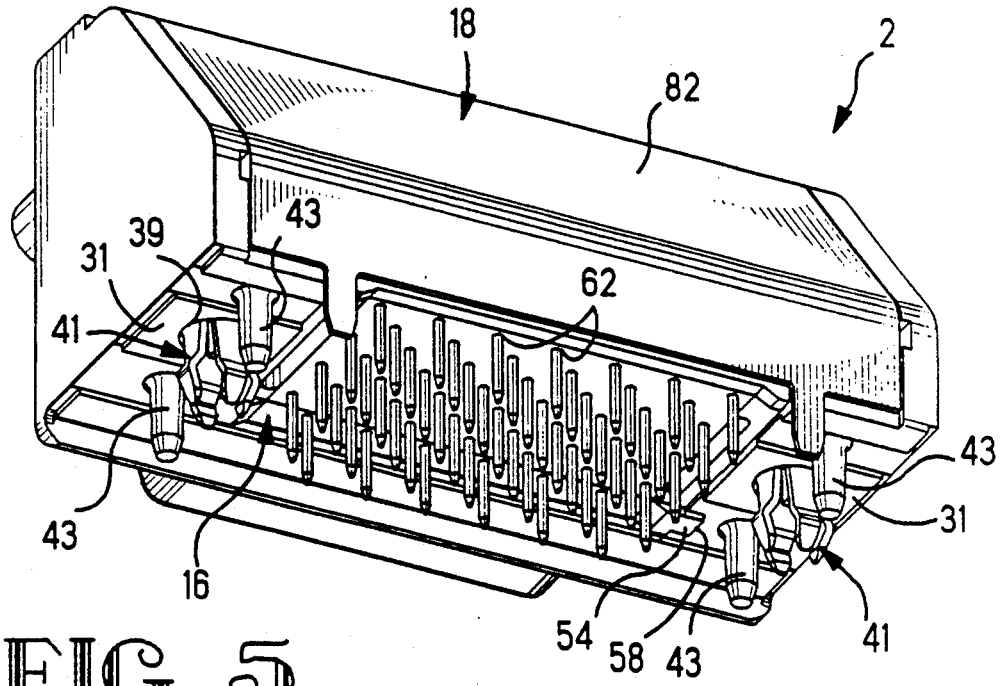
FIG. 5 is a bottom isometric view of the connector of FIG. 2.
Figure 6:
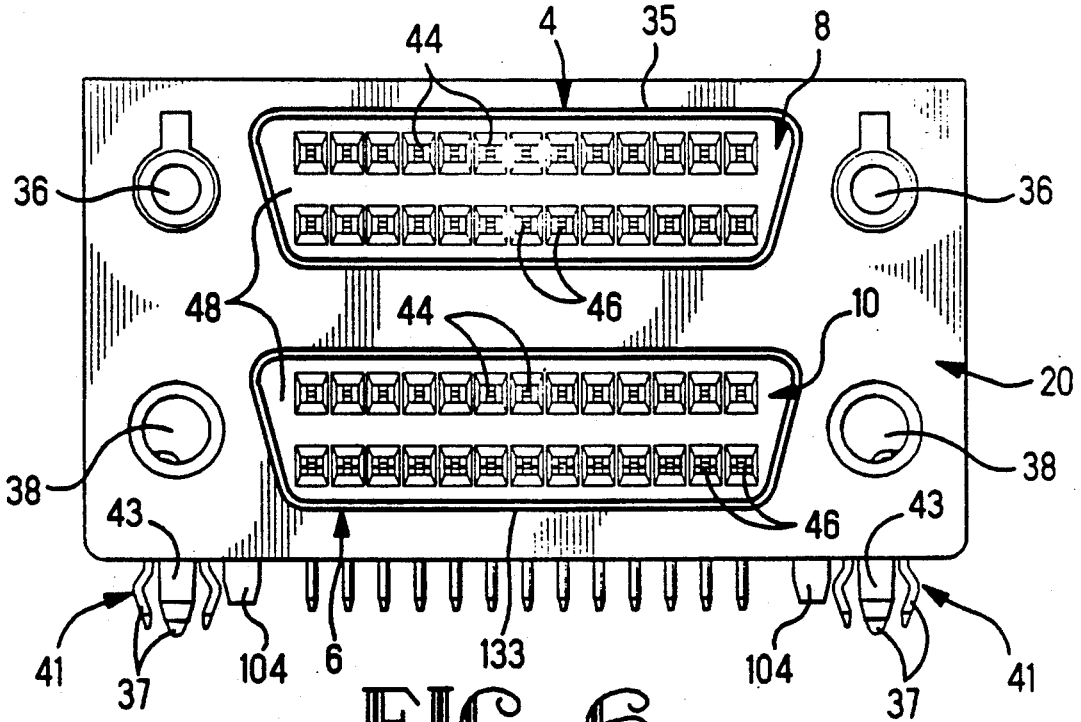
FIG. 6 is a front elevational view of the connector of FIG. 2.
Figure 10:
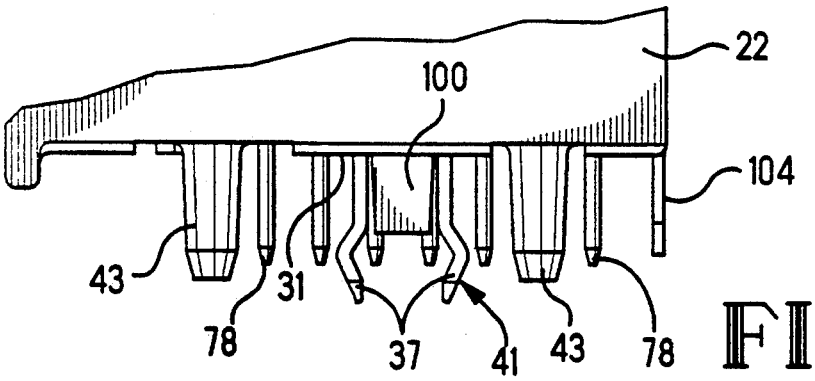
FIG. 10 is a fragmentary side view illustrating details of the connector of FIG. 2.
Figure 11:
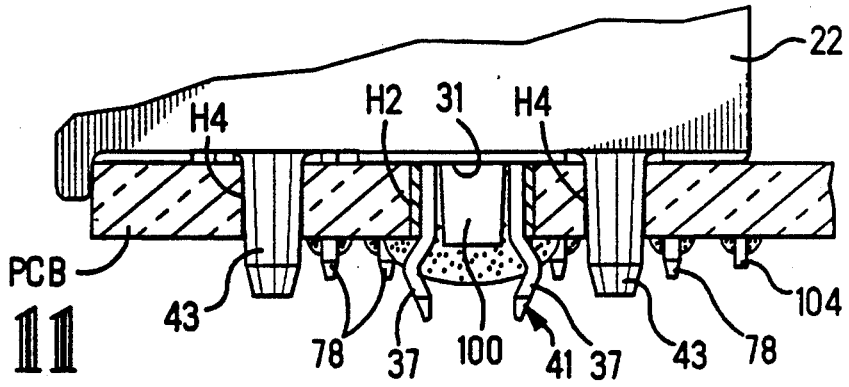
FIG. 11 is a fragmentary side view shown partly in section illustrating details of the connector of FIG. 2, when it has been mounted to the circuit board.

The die cast housing 2 comprises a front wall 20 and opposite side walls 22 tapering rearwardly from opposite ends of the front wall 20, each side wall 22 having a downwardly inclined upper edges 24, a horizontal bottom edge 26 extending at right angles to the front wall 20 and a vertical rear edge 28 joining the edges 24 and 26, parallel with the wall 20. The housing 2 is best seen in FIGS. 3 and 6. The housing 2 has a pair of board engaging members in the form of opposed, rudimentary, bottom walls 30 projecting inwardly of the housing 2, from the side walls 22, proximate to their bottom edges 26. Each wall 30 has a board engaging bottom face 31 (FIGS. 5, 10 and 11). The housing 2 also has a rudimentary forward top wall 32 extending rearwardly from the upper end of the front wall 20 and spanning the side walls 22. Each edge 24 is joined to the top wall 32 at a short, horizontal top edge 33.

The front wall 20 is formed with a pair of spaced keys 36 cast therein or threadably securable thereto with key 36 being representative of both versions, near its upper end, each key 36 being located proximate to a respective side wall 22. Below each key 36 the front wall 20 is formed with threaded screwlocks 38. The keys 36 and the screwlocks 38 are provided for cooperation with complimentary keyways and jack screws, respectively, of an electrical connector (not shown) for mating with the connector 1.

Keys 36 may have a threaded shank receivable in a threaded aperture in front wall 20 or may be cast into housing 2. Keys 36 project forwardly of wall 20 and have a keying rib 37 thereon. Typically the keys are provided in pairs with the rib 37 on each key 36 oriented in the coordinated directions. The rib 37 may take on other angular positions Typical positions are at equal angular orientations such as vertically as shown, both laterally outwardly—the rib on the left key to the left and the rib on the right key to the right—, and both vertically downward. The central bore of the key may be threaded to receive a jackscrew. The same structure as key 36, without rib 37, forms a screwlock.

As shown in FIG. 6 between the keys 36, the front wall 20 is formed with an upper, laterally elongate, through opening 35, and between the keyways 38, with a lower, lateral, elongate through opening 133, as shown in FIG. 6. Each bottom wall 30 is formed with an inwardly projecting lower step 40 extending the full length thereof and has a central through bore 39 extending through the board engaging face 31 of the wall 30, in which is secured a hollow board lock 41, in the manner described in, and being constructed according to, the teaching, U.S. Pat. No. 4,842,552 which is hereby incorporated herein by reference. Each board lock 41 comprises an annular strap supported in the respective bore 39 and from which strap depend below the face 31 four locking legs 37. There depends from each bottom wall 30 of the housing 2, on each side of each board lock 41 therein, a board mounting protrusion 43. The inner face of each side wall 22 is formed, just above the respective bottom wall 30, with a longitudinal latching groove 42 extending the full length of the side wall 22.

The drawn shells 4 and 6, which are constructed according to the teaching of U.S. Pat. No. 4,808,125 which is hereby incorporated herein by reference, are secured in the openings 35 and 133 respectively, according to the teaching of that U.S. Patent. In this manner, both shells 4 and 6 are electrically commoned with housing 2. A shielded mating connector engaging either shell 4 or 6 is grounded to a circuit board on which connector 1 is mounted through housing 2 and boardlock 41 to a ground trace on the circuit board. The headers 8 and 10 are secured in the shells 4 and 6, respectively, also in the manner taught by U.S. Pat. No. 4,808,125. Each header 8 and 10 has an upper row of terminal receiving, through cavities 44 and a lower row of terminal receiving, through cavities 46. Each cavity 44 and 46 opens into a front mating face 48, and a rear terminal receiving face 50, of the respective header 8 and 10.

The terminal tail spacer plate 16 is constructed according to the teaching of U.S. patent application Ser. No. 757,086 filed on Sep. 10, 1991 and which is hereby incorporated herein by reference. The plate 16 rests upon the steps 40 of the bottom walls 30 and has lugs 52 and 54 at each end of the plate 16, which engage in complimentary recesses of the inner faces 56 of the walls 30. The plate 16 has a rear 63, extending the full length thereof. There are provided in the plate 16, a plurality of longitudinally extending rows of terminal tail receiving through holes 62.

The group 12 of terminals comprises an upper row of first terminals 64 and a lower row of second terminals 66, the group 14 of terminals comprising an upper row of third terminals 68 and a lower row of fourth terminals 70. Each terminal 64, 66, 68, 70 is uniplanar and comprises a forked, forward mating portion 72, a retention portion 74 extending rearwardly therefrom, the portions 72 and 74 being rectilinear and being longitudinally aligned with each other, a rectilinear leg 76 extending rearwardly from the portion 74 and being downwardly angled with respect thereto, and terminating in a solder tail 78 depending from the bottom of the leg 76 at right angles to the portions 72 and 74. The mating portions 72 of the terminals 64 are received in respective cavities 44 of the upper row of cavities of the header 8, the mating portions 72 of the terminals 66, being received the cavities 44 of the lower row of cavities 46 of the header 8. The mating portions 72 of the terminals 68 are received in respective cavities 44 of the upper row of cavities of the header 10, the mating portions 72 of the terminals 70 being received in the cavities 46 of the lower row of cavities of the header 10. The retention portions 74 of the terminals, each of which portions is transversely enlarged, in its own plane, serve to retain the terminals in the cavities, with the forked mating portions 72 of the terminals projecting towards the respective mating faces 48. The legs 76 of the terminals 64 are longer than those of the terminals 66, the legs 76 of the terminals 66 being longer than those of the terminals 68 and the legs 76 of the terminals 68 being longer than the legs 76 of the terminals 70. The downward angle of the legs 76 of the terminals 64 may be less than that of the legs 76 of the terminals 76, the angle of the legs 76 of the terminals 66 being less than that of the terminals 68 and the angle of the legs 76 of the terminals 68 being less than that of the legs of the terminals 70.

By virtue of these configurations of the legs 76, the solder tails 78 of the terminals 64 extend through the holes of the rearmost row of holes 62 in the plate 16, the tails 78 of the terminals 66 extending through the holes of the next rearmost row of holes 62, the tails 78 of the terminals 68 extending through the holes of next row of holes 62 in the forward direction and the tails 78 of the terminals 70 extending through the holes of the foremost row of holes 62 in the plate 16. The spacer plate 16 is pressed over the tails 78 according to the teaching of the patent application mentioned above.

Figure 7:
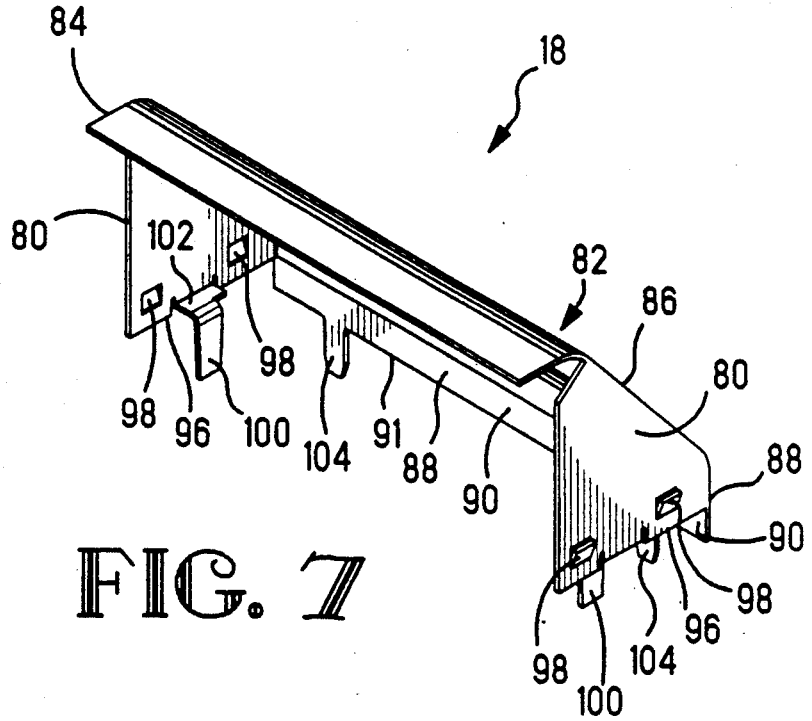
FIG. 7 is an isometric view of the metal shield of the connector of FIG. 2.
Figure 8:
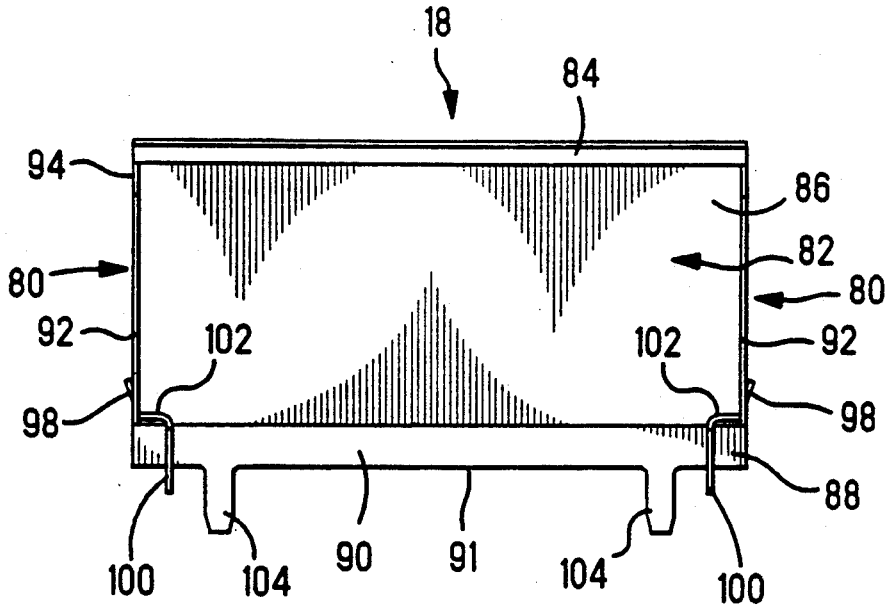
FIG. 8 is a front elevational view of the shield of FIG. 7 showing the interior thereof.
Figure 9:
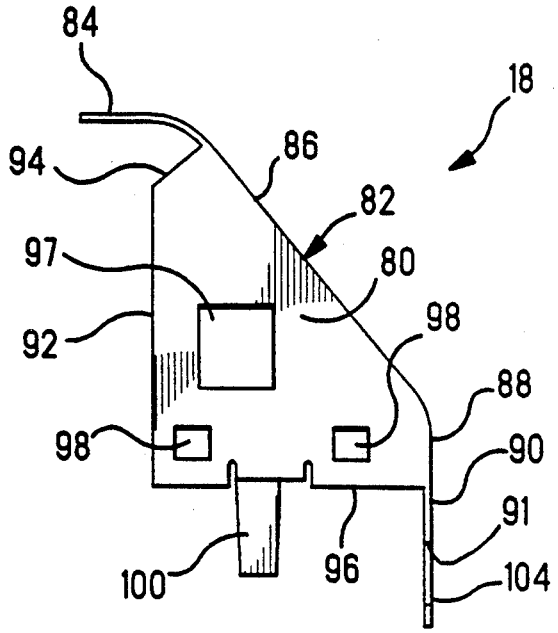
FIG. 9 is an end view of the shield of FIGS. 7 and 8.

As best seen in FIGS. 7 to 9, shield 18, which has been stamped and formed from a single piece of sheet metal stock, comprises opposite side walls 80 of substantially triangular shape, a rear wall generally referenced 82 and a top wall in the form of a forwardly projecting cantilever flap 84 which is free of the walls 80, the shield 18 being open forwardly. The rear wall 82 comprises a rearwardly, and downwardly, inclined upper forward portion 86, a lower rear portion 88, and a lowermost rear portion 90 depending below the side walls 80 and having a bottom edge 91. The side walls 80 are connected only by the wall portions 86 and 88. The side walls 80 have vertical forward edges 92, surmounted by forwardly and downwardly inclined edge portions 94 configured to allow resilient flexure of the flap 84 as will best be apparent from FIG. 9. Each sidewall 80 may have a lateral positioning window 97 (shown in FIGS. 9, 13 and 14) to prevent lateral movement of shield 18 in housing 2 prior to soldering. The window engages the inner surface of sidewalls 22 to prevent the lateral motion, and concomitantly provide additional points of electrical continuity therebetween.

The side walls 80 have bottom edges 96. Each side wall 80 has, proximate to its bottom edge 96, a pair of struck out, outwardly and upwardly inclined, latching tongues 98. Between its tongues 98, each side wall 80 has a central, flat, grounding tab 100, connected to the edge 96 of the wall 80 by a horizontal strap 102 normally thereof. Each tab 100 is thereby offset inwardly of the respective wall 80 in parallel relationship therewith. There may depend from the bottom edge 91 of the wall portion 88 pair of further flat grounding tabs 104, which are coplanar therewith and the planes of which extend at right angles with those of the tabs 100. The free ends of the tabs 104 may lie below those of the tabs 100.

In order to mount the shield 18, to the partially completed connector shown in FIG. 3, the shield 18 is moved down vertically with its tabs 100 and 104 leading, into the die-cast metal housing 2, so that the latching tongues 98 on each side wall 80 of the shield 18 are initially pressed inwardly and then resile outwardly to latch into respective grooves 42 in the side walls 22 of the housing 2. Windows 97, if present, are pressed inwardly but biasingly engage the inner surface of walls 22. The flap 84 of the shield 18 is simultaneously resiliently depressed and inserted under the top wall 32 of the housing 2. In this manner, the rear wall portions 86 and 88 of the shield 18 cover the rear edges of the terminals of the groups 12 and 14 but are spaced therefrom, the lowermost rear wall portion 90 of the shield 18 abutting in face-to-face relationship against the rear wall 63 of the spacer plate 16 and the tabs 104 projecting therebelow and therebehind. In this assembled position of the shield 18, each tab 100 thereof projects through the annular strap of a respective one of the board locks 41, and extends between the locking legs 37 thereof, as best seen in FIG. 10. The resilient engagement of the flap 84 against the top wall 32 urges the bottom edge 96 of the shield 18 down against the bottom walls 30. The complete connector 1 is shown in FIGS. 2, and 4 to 6.

The circuit board PCB (FIG. 2) upon which the assembly 1 is to be surface mounted, has provided therein an array of smaller, plated through holes H1 for receiving the terminal tails 78, two larger, plated through holes H2 for receiving the board locks 41, two further, plated through holes H3 for receiving the tabs 104, four further through, unplated holes H4 for receiving the mounting protrusions 43 of the housing 2.

When the connector 1 has been mounted to the board PCB with the terminal tails 78, the board locks 41, the tabs 104 and the mounting protrusions 43 projecting through the holes provided for them in the board PCB, as shown in FIG. 11, the parts projecting below the board PCB, of the terminal tails 78, are soldered to respective signal conductors (not shown) on the board PCB, the locking legs 37 of the board locks 41, and the tabs 104 being soldered to ground conductors (not shown) on the board PCB. Since the tabs 100 extend into the board locks 41, they are likewise soldered to the grounding conductors to which the legs 37 are soldered, as shown in FIG. 11. No additional plated through holes in the board PCB have, therefore, to be provided for the tabs 100. The drilling program for the board is thereby simplified and lining metal is saved.

When shield 18 has as many tabs 100 (or 104) as the connector has boardlocks, there are no additional through holes required solely to accommodate additional shield grounding tabs. When shield 18 has more tabs 100 (or 104) than boardlocks, the number of through holes required can be minimized by having at least some of the through holes perform a dual function of providing a boardlocking function, and possibly concomitantly grounding through the boardlock, as well as providing a path to ground for a ground tab on shield 18.

Further, the board locks 41 serve to protect the tabs 100 from stubbing against the board PCB when the connector 1 is being mounted thereto, or being otherwise damaged when the connector 1 is being handled.

Figure 12:
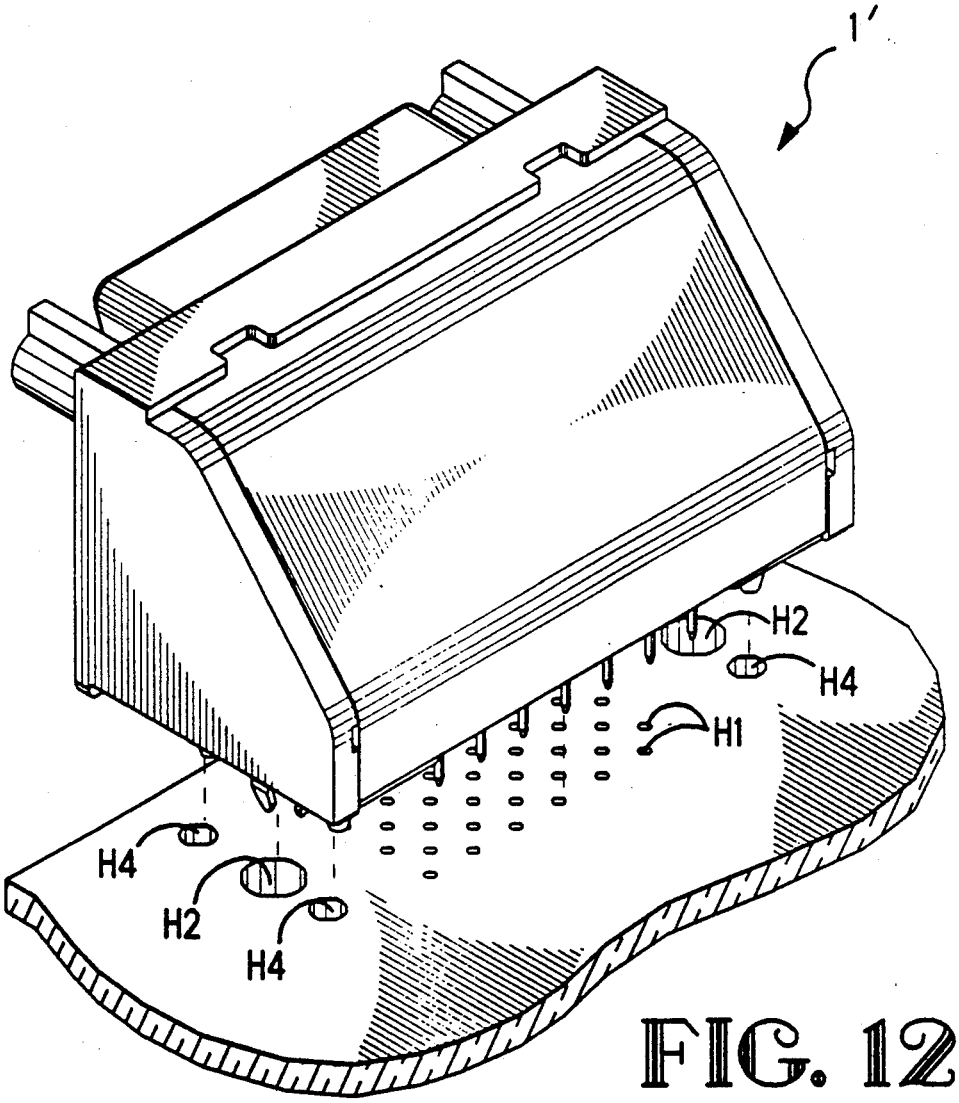
FIG. 12 is a similar view to that of FIG. 2, but illustrating a modification of the metal shield.

The connector 1' shown in FIG. 12 is the same as connector 1 described above, excepting that the tabs 104 of the shield are not provided. The provision of the holes H3 in the circuit board is accordingly avoided.

Figure 13:
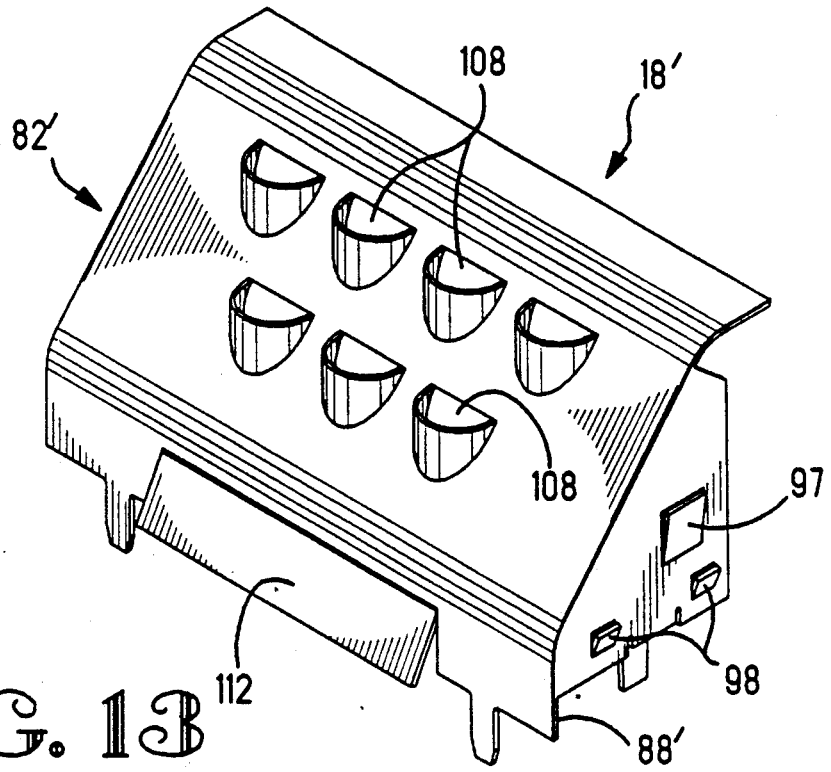
FIG. 13 is a rear isometric view illustrating further modifications of the metal shield.
Figure 14:
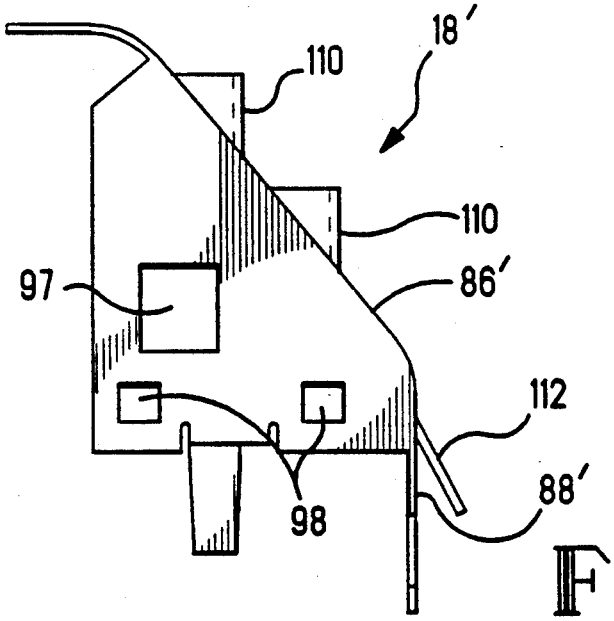
FIG. 14 is an end view of the shield of FIG. 13.

As shown in FIGS. 13 and 14, a shield 18' according to an alternative embodiment, is the same as the shield 18, excepting that the wall portion 86' of the rear wall 82' is formed with rows of holes 108 provided with struck out, semi-circular funnels 110 extending thereabout for the introduction of cleaning fluids, which may be liquids or gases, to flush out debris from beneath the terminal tail spacer plate. The liquids may flush out debris that might otherwise short between solder tails; air may be used to dry. This may be achieved with shield 18' in place. The wall portion 88' is provided with a rearwardly inclined flap 112 to allow for the egress of the said fluids.

What is claimed is:

1. An electrical connector for mounting on a circuit board having at least one aperture for receiving a boardlock, the connector comprising:

a housing having a bottom wall with a bottom surface for engaging against the circuit board, the bottom wall having formed therein a through bore opening into said bottom surface;

a board lock secured in said bore and having a portion projecting below said bottom surface for insertion into a boardlock receiving aperture in the circuit board;

terminals secured in the connector with terminal legs thereof extending to proximate the bottom surface for soldering to traces on the circuit board; and a metal shield covering the terminals, the metal shield having a grounding tab depending from said shield projecting proximate said board lock and adapted to be received in the same aperture in the circuit board as the boardlock.

2. A connector as claimed in claim 1, wherein the housing has a top wall, the shield having a top flap resiliently engaging beneath said top wall and urging the shield down against the bottom wall of the housing.

3. An electrical connector as recited in claim 1, wherein the shield further comprises side walls, at least one side wall having an outwardly angled centering flange resiliently engagable with an inner surface of a wall of said housing to prevent lateral movement of the shield relative to the housing.

4. An electrical connector as recited in claim 1, wherein the portion of the boardlock projecting below said bottom surface comprises locking legs, the shield grounding tab receivable between the locking legs.

5. A connector as claimed in claim 1, wherein the housing has opposite side walls formed with horizontal grooves opening into the inner surfaces of the side walls, the shield having opposite side walls formed with latching tongues projecting outwardly of the shield, the shield being received between the housing side walls with the latching tongues of the shield side walls latchingly engaging in said grooves.

6. A connector as claimed in claim 5, wherein the shield has an inclined rear wall bridging the side walls of the shield and extending across the terminal legs, and a vertical rear wall portion projecting from said inclined rear wall below said side walls.

7. A connector as claimed in claim 1, wherein the shield has a vertical wall having a bottom edge resting against the bottom wall of the housing, a strap projecting normally from said vertical wall and the grounding tab projecting from an end of said strap remote from said vertical wall and below the bottom edge thereof.

8. An electrical connector for mounting to a circuit board, said connector comprising:

an insulating header having a mating face and a terminal receiving face and defining a plurality of terminal receiving through cavities each opening into both of said faces;

an array of electrical terminals secured in the header, each terminal having a mating portion received in a respective one of said cavities and extending towards the mating face and a terminal leg extending outwardly of said terminal receiving face and terminating in a soldering tail;

board engaging members connected to the header and each having a board engaging face and a through bore opening into the board engaging face;

a board lock supported in each through bore and having a portion projecting from said board engaging face for insertion through a hole in the circuit board; and a metal shield having grounding tabs depending therefrom, the metal shield being assemblable to the connector to shield said terminals, with the grounding tabs extending into said portion of said board locks.

9. An electrical connector as recited in claim 8, wherein the shield further comprises side walls, at least one side wall having an outwardly angled centering flange resiliently engagable with an inner surface of a wall of said housing to prevent lateral movement of the shield relative to the housing.

10. An electrical connector as recited in claim 8, wherein the portion of the boardlock projecting below said bottom surface comprises locking legs, the shield grounding tab receivable between the locking legs.

11. A connector as claimed in claim 8, comprising a housing having a front wall from which extend rearwardly a pair of spaced side walls, the header being fixed in the front wall with the mating face of the header directed forwardly, each board engaging member constituting a rudimentary bottom wall projecting inwardly from a respective one of the side walls, the housing having a top wall spanning the side walls, the terminal legs depending between the side walls and the bottom walls.

12. A connector as claimed in claim 11, wherein the shield has side walls having bottom edges engaging the bottom walls of the housing and a rear wall spanning the shield side walls, a top flap projecting from the rear wall of the shield, engaging resiliently beneath the housing top wall and urging the bottom edges of the shield against the bottom walls of the housing, the grounding tabs projecting from respective ones of said bottom edges.

13. A connector as claimed in claim 11, wherein the shield has side walls formed with latching tongues projecting obliquely upwardly and outwardly of the shield, grooves formed in opposite inner faces of the housing side walls and being located proximate to the housing bottom walls, latchingly receiving said latching tongues.

14. A connector as claimed in claim 11, comprising a terminal tail spacer plate lodged between the housing bottom walls and having through holes through which the soldering tails extend, the spacer plate being a rear bead, a rear wall portion of the shield projecting from the shield rear wall below said bottom edges engaging the bead in face to face relationship.

15. A connector as claimed in claim 11, wherein each side wall of the shield has a strap projecting normally, and inwardly, thereof, each grounding tab projecting from an end of the respective strap normally thereof.

16. A connector as claimed in claim 12, wherein the rear wall of the shield is formed with through holes provided with struck out funnels for receiving cleaning fluid to flush out debris from beneath the spacer plate.

17. A shield as claimed in claim 16, wherein a strap projects from a bottom edge of each side wall inwardly thereof and normally thereof, each grounding tab projecting downwardly from an end of a respective one of said straps and normally thereof.

18. A shield as claimed in claim 16, wherein the rear wall is formed with at least one row of through holes and a struck out, semi cylindrical funnel extending about each through hole, a lower portion of said rear wall extending below the bottom edges of the side walls and being formed with a flap projecting obliquely downwardly and away from said lower most wall portion.

19. A stamped and formed one piece, sheet metal shield for a surface mounted right angle electrical connector, the shield comprising opposite side walls of substantially triangular shape, a rear wall connecting inclined edges of the side walls, a cantilever flap projecting forwardly from an upper edge of said rear wall, the shield being open forwardly thereof, and a grounding tab projecting from a lower edge of each side wall, the rear wall having a rearwardly, and downwardly, inclined upper forward portion and a vertical lower rear portion.

20. A shield as claimed in claim 19, wherein each side wall has struck out therefrom a pair of latching tongues, each latching tongue projecting obliquely upwardly and outwardly of the side wall, the latching tongues of each side wall being disposed on either side of the grounding tab of that side wall.

21. A shield as claimed in claim 19, wherein there depends from the lower rear portion of the rear wall, a lowermost rear portion, below the bottom edges of the side walls at right angles to said bottom edges, there depending from a bottom edge of said lowermost rear wall portion, at least one further grounding tab in coplanar relationship with said lowermost rear portion.

* * * * *